US005207499A

United States Patent [19]

Vajda et al.

[11] Patent Number: 5,207,499

[45] Date of Patent: May 4, 1993

[54] INTEGRAL LIGHT AND LIQUID CIRCULATION FITTING

[75] Inventors: Jason Vajda, Scranton, Pa.; Laurence E. Thrasher; Kenneth M. Kowal, both of Simi Valley, Calif.; Lucjan Berczynski, Glendale, Calif.

[73] Assignee: KDI American Products, Inc., Moorpark, Calif.

[21] Appl. No.: 710,178

[22] Filed: Jun. 4, 1991

[51] Int. Cl.[5] ..... F21V 33/00

[52] U.S. Cl. ..... 362/96; 362/101; 362/362; 362/373; 4/541.3; 4/492

[58] Field of Search ..... 362/96, 101, 362, 373; 239/17, 18, 20, 211; 4/541.4, 541.6, 492, 541.3

[56] References Cited

U.S. PATENT DOCUMENTS

| | | | |
|---|---|---|---|
| 1,968,072 | 7/1934 | Creighton | 240/2 |
| 3,192,379 | 6/1965 | De Garmo | 240/26 |
| 4,088,880 | 5/1978 | Walsh | 362/96 |
| 4,216,411 | 8/1980 | Ehret et al. | 315/118 |
| 4,363,080 | 12/1982 | Sylvester | 362/101 X |
| 4,450,511 | 5/1984 | Micha | 362/267 |
| 4,539,629 | 9/1985 | Poppenheimer | 362/267 |
| 4,616,298 | 10/1986 | Bolson | 362/96 X |
| 4,661,893 | 4/1987 | Robinson et al. | 362/267 |
| 5,041,950 | 8/1991 | Tyson | 362/96 |
| 5,051,875 | 9/1991 | Johnson | 362/101 |

*Primary Examiner*—Larry Jones

*Attorney, Agent, or Firm*—Noel F. Heal; Lois Babcock

[57] ABSTRACT

A light assembly combined into a unitary structure with a liquid circulation fitting, such as a water return fitting, for use underwater or above water in a pool, tub, spa, fountain, or similar large liquid container. The combination is well suited for use as a combined underwater light and return water fitting in pools, tubs, or spas, and especially in above-ground pools, and as a combined ornamental light and fountain jet. The unitary structure eliminates the need for more than one hole in the pool wall and thereby simplifies installation and decreases the chance of leaks. The structure provides for both water and air cooling if the light is installed underwater. Furthermore, the structure is connectable to water supply lines of various sizes, and includes a directionally adjustable port to control water returning to the pool or container.

28 Claims, 4 Drawing Sheets

INTEGRAL LIGHT AND LIQUID CIRCULATION FITTING

BACKGROUND OF THE INVENTION

This invention relates generally to lights and water or other liquid circulation fittings used in pools or other liquid containers. More particularly, the invention relates to underwater or above-water pool lights and is especially well suited for installation in above-ground pools, vinyl liner pools, ornamental fountains, tubs and spas.

An underwater pool light generally requires that a hole be made in the wall of the pool for installation. This increases the chance of leaks and sometimes requires extra reinforcing of the pool wall.

A return water inlet fitting also requires that a hole in the wall of the pool for its installation and connection to a circulation pump. This also increases the chance of leaks.

Many available pool lights cannot be used in vinyl liner pools because their mounting may require a niche in the pool wall. Other underwater lights cannot be used in vinyl liner pools because of their large size and weight.

Another common difficulty is that some underwater lights must be removed and completely disassembled just to replace a bulb, adding to their inconvenience and requiring experienced personnel for maintenance. Other lights have no means of cooling or may have just one, less than adequate, method of cooling, resulting in reduced bulb life and increased maintenance costs.

Another drawback of some underwater lights is their use of clear covers or lenses, providing no directional control over the light output. These lights have a tendency to illuminate not just the pool but also the surrounding area. The resulting glare is both an inconvenience and a safety hazard.

It will be appreciated from the foregoing that there has long been a need for improvement in the field of lights for pools and other large containers of liquids, and specifically in the field of underwater pool lights. In particular, there has been a need for a pool light that does not require an additional opening to be made in the wall of a pool, thereby reducing installation cost and the chance of leaks. Ideally the light should provide for adequate cooling, should be easy to maintain, safe to operate, and able to direct the flow of water to aid a pool skimmer in collecting debris. The present invention satisfies all these requirements.

SUMMARY OF THE INVENTION

The present invention resides in a combination of a light assembly and a liquid circulation fitting formed as a unitary structure. Briefly, and in general terms, the invention includes a light assembly for installation in a liquid container, and a liquid circulation fitting through which liquid flows to or from the container.

More specifically, in one preferred embodiment of the invention, the liquid circulation fitting is a return water inlet fitting formed integrally as a unitary structure with a light assembly to be installed in a single opening in the wall of a pool, tub or spa, and is connected to a water circulation pump that returns circulating water from the pump.

The unitary structure of the invention includes means for cooling the light assembly, thereby extending its life by reducing possible damage due to overheating. Cooling the light assembly is effected by means for circulating water around it and means for circulating air within it. Venting for the air circulation is provided through vents in an electrical junction box external to the pool but coupled to the light assembly.

The means for circulating water around the light assembly has a water line fitting for coupling the circulation pump to an opening in the return water inlet fitting, and a directionally adjustable port surrounding the light assembly. The means for circulating water around the light assembly is sealed from the light assembly with a water tight seal. The directionally adjustable port permits the water to emerge into the pool in any desired direction, and provides the capability to control the return flow into the pool in a manner that aids a pool skimmer in collecting debris. This directionally adjustable port includes a rotatable annular element surrounding the light assembly, having a plurality of openings through which water emerges in the desired direction.

The water line fitting is designed to accommodate any of a plurality of water line sizes. However, the water return inlet fitting is designed to have a water passage with a cross-sectional area larger than that of the water line, to minimize flow restriction.

In the unitary structure of the invention the means for circulating air within the light assembly includes a cavity within the light assembly coupled to a cavity formed by the electrical junction box, these coupled cavities being sealed from the means for circulating water around the light assembly. The electrical junction box has a plurality of exit vents through which heated air can escape to the exterior of the pool wall.

The light assembly itself has a light source and a lens that is attached to a face of the assembly. The light source is preferably a low-voltage, high-output quartz halogen bulb. Alternatively, optical fibers can be used to transmit light from a remote source into the structure. The lens serves both to direct light into the pool and to form a watertight light assembly.

The unitary structure also includes means for preventing rotation of the light assembly with respect to the return water inlet fitting, and means for releasably securing the light assembly within the unitary structure. These features allow the light assembly to al removal or rotation of the light assembly, so that light is dispersed only in a preferred direction.

The unitary structure also includes means for adjustably mounting the device in pools having walls of various thicknesses. Therefore, the structure of the invention can be installed conveniently in existing openings used for water return inlet fittings.

Another embodiment of the invention includes multiple lenses through which light passes on its way to the pool, and around which liquid is circulated.

It will be appreciated from the foregoing that the present invention represents a significant advance in the field of underwater light fittings for pools, tubs, or spas. In particular, the invention provides an underwater light without the need for an additional hole in the pool wall. In addition the invention provides multiple means of cooling the light assembly, thereby extending the bulb life. The device of the invention is especially suitable for mounting on above ground pool walls, and is adjustable to fit walls of various thicknesses. Further, the device of the invention is also easier to retrofit in existing installations that already include a liquid circulation fitting. In one preferred form of the invention, the water circulated around the bulb for cooling purposes can be adjustably directed to aid the skimmer in collecting debris. Other aspects and advantages of the invention will become apparent from the following more detailed description, taken in conjunction with the accompanying drawings.

DESCRIPTION OF THE PREFERRED EMBODIMENT

Figure 1:
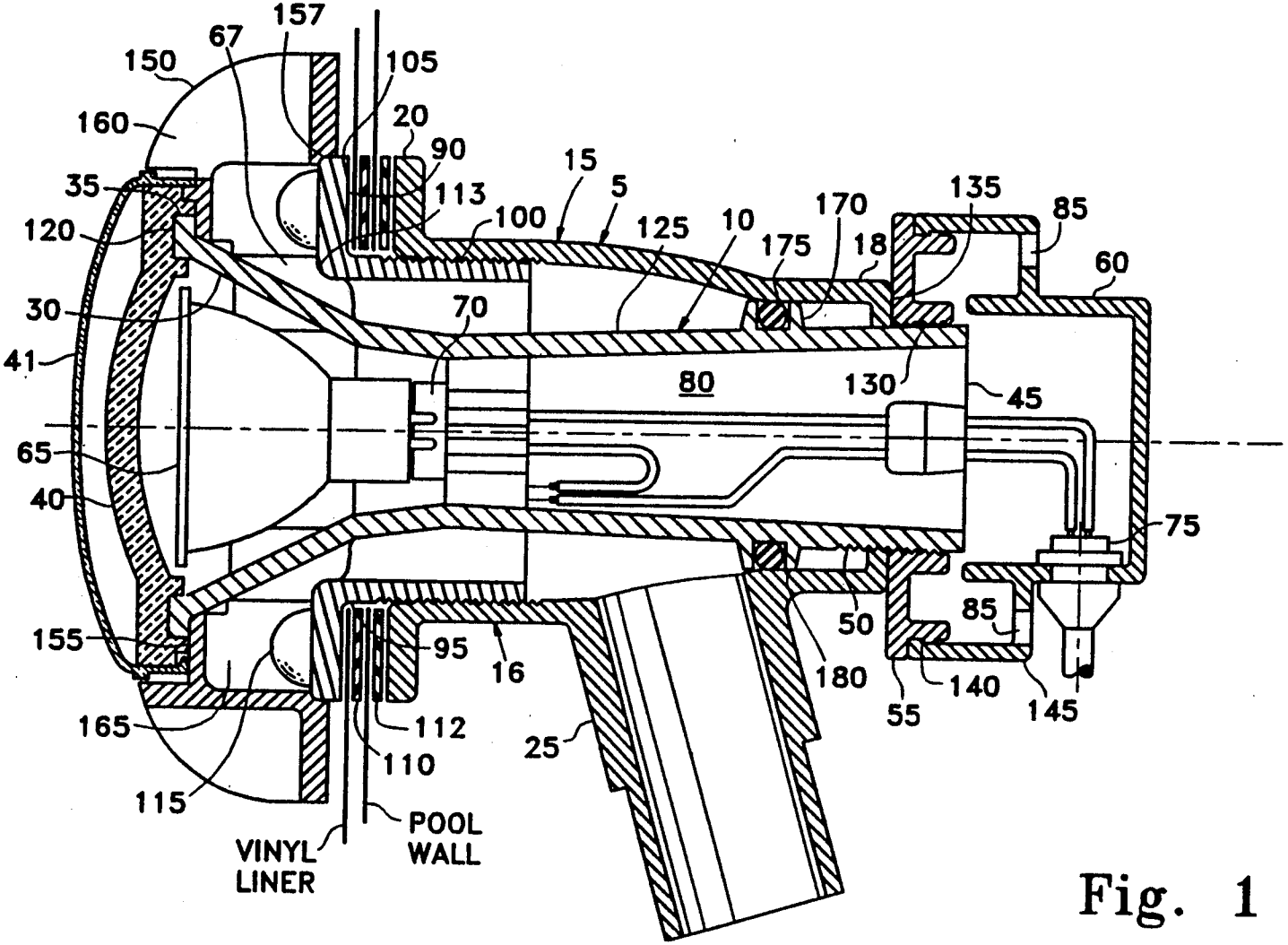
FIG. 1 is an elevational view of the underwater return light fitting embodying the invention.

As shown in the drawings for purposes of illustration, the present invention is concerned with improvements in the field of light assemblies and liquid circulation fittings. Prior to this invention light assemblies used in liquid containers required a hole in the container wall for the fitting, or to make connection to a power supply. The liquid circulation fitting required another opening to be made in the container wall for its installation and connection for circulation. This need for at least two openings in the container wall increased the possibility of leaks. One preferred embodiment of the invention is concerned with underwater pool lights and water return fittings.

In accordance with the present invention, and as shown by way of example in FIG. 1, a return water inlet fitting 5 for connection to a circulation pump to return circulating water from the pump, and a light assembly 10 for installation beneath the water level in a pool, tub, or spa, are combined in a unitary structure 15. The light assembly 10 is mounted inside the return water inlet fitting at the pool wall.

More specifically, the return water inlet fitting 5 is generally cylindrical in shape, but is tapered from its front end 16 to a smaller diameter along a central portion of its length to the rear end 18, and has an opening at each end. An external flange 20 is formed integrally with the fitting at its larger diameter end. This flange 20 provides a surface for mounting and securing the underwater return light fitting to the pool wall. The return fitting 5, when installed, is located for the most part behind the pool wall, and has an integral water line slip fitting 25, having portions of different external diameters to accommodate water lines of various sizes. As shown in FIG. 1, the slip fitting 25 extends obliquely from the water return fitting 5, specifically from its tapered central portion.

The light assembly 10 has a generally cylindrical body, with a flared conical portion at one (front) end 30, and an end flange 35 adapted to sealably engage a lens 40. The assembly 10 also has a rear end 45 and an externally threaded end portion 50 for engaging a lock nut 55 to which an electrical junction box 60 is attached. The light assembly 10 encloses a bulb 65, socket 70, and an electrical connector 75, while forming an air chamber 80 for cooling the bulb. The electrical junction box 60 has vents 85 to the exterior of the pool for releasing hot air.

For mounting in a pool wall, the larger diameter end of the return water inlet fitting 5 is internally threaded, as indicated at 16, to receive a securing ring 90. The ring 90 has a hollow cylindrical body 95, externally threaded at one end 100 to engage the return fitting 5, and having an external flange 105 at its other end. Flange 20 is mounted against the exterior of the pool wall and flange 105 against the interior of the pool wall. Around the opening in the pool wall a gasket 110 is placed between the vinyl liner and the pool wall, and another gasket 112 is held in place against the outside of the pool wall and around the opening as the securing ring 90 is tightened onto the threaded end of the fitting 16, using thumb tabs 115 formed on the flange 105 of the securing ring. This action secures the return water inlet fitting 5 in the opening.

Figure 2:
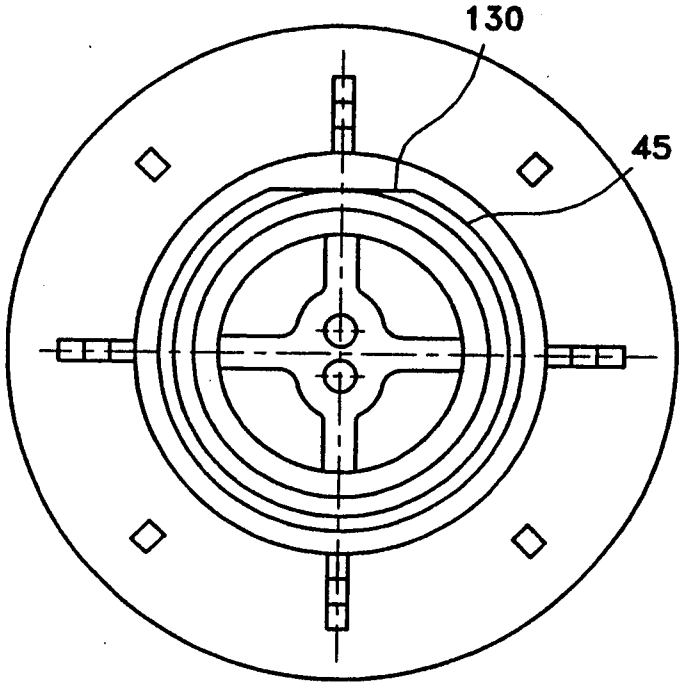
FIG. 2 is a rear view of the light assembly, showing a flattened portion that prevents rotation.

The light assembly 10 is also generally cylindrical, with a flared portion at the front end 30 to accommodate the halogen bulb 65, and having an integral external flange 35. Four radial tabs 67 are evenly spaced around the flared portion of the light assembly 10, and abut the securing ring 90 at a rounded edge 113 where the flange 105 joins the securing ring 90. The abutment of these tabs against the flange 105 fixes the distance between the flange 105 or the securing ring 90 and the flange 35 at the front end of the light assembly 10. The lens 40 has an annular slot 120 formed around its perimeter and sized to fit over the flange 35 for ultrasonic welding in place. The lens cover 41 snaps in place around the outer diameter of the lens 40. The halogen bulb 65 fits in the socket 70 located centrally within the front end 30 of the light assembly. An end portion of the rear end 45 of the body 125, is externally threaded, as shown in FIG. 2, but has flattened, i.e. noncircular and therefore nonthreaded region 130 that engages a corresponding region of the opening formed by the internal flange 135 at the end 18 of the return fitting body 5. As best shown in FIG. 2, the flattened region 130 prevents rotation of the light assembly 10 with respect to the return fitting 5. The lock nut 55 engages the externally threaded portion 50 of the light assembly 10 adjacent to the return water inlet fitting 5 to secure the light assembly 10 to the return fitting.

The lock nut 55 includes an integral cylindrical flange 140 that serves to secure the electrical junction box 60 in place. The electrical junction box 60 has a cylindrical flange 145 that fits over the rear end 45 of the light assembly 10.

Figure 3:
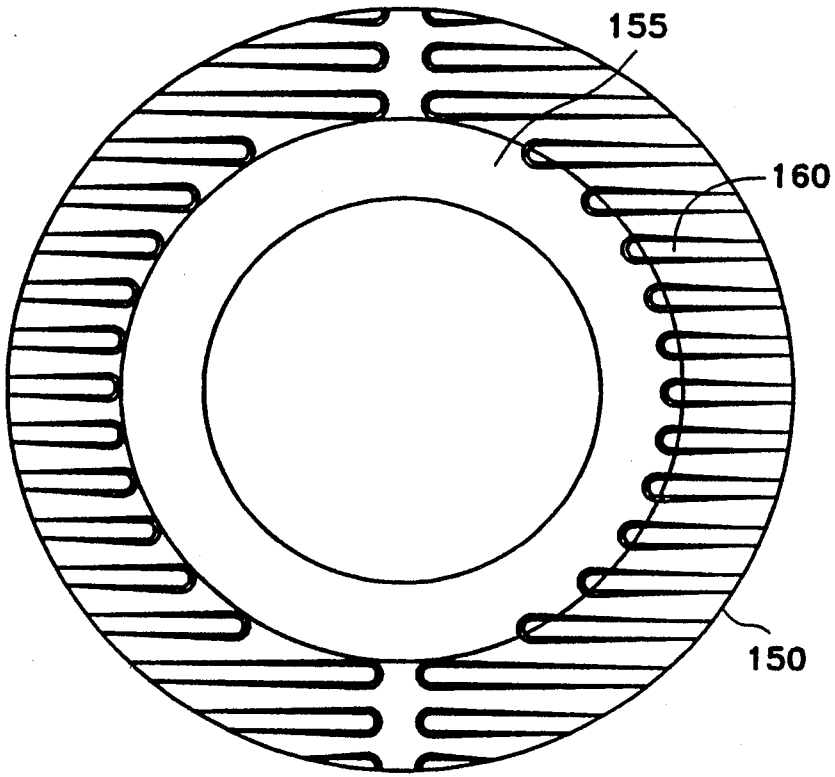
FIG. 3 is a front view of a rotatable annular element surrounding the light assembly, showing a plurality of openings through which water emerges.

A rotatable annular element 150 fits over the opening between the flange 35 on the front end 30 of the light assembly 10 and the flange 105 on the securing ring 90. An internal flange 155 in the element 150 fits behind the flange 35 of the light assembly 10. The annular element 150 also has a rear annular bearing surface 157 that engages a corresponding bearing surface on the flange 105 of the securing ring 90. When the lock nut 55 is tightened to secure the light assembly 10 to the return water inlet fitting 10, the annular element 150 is secured between flanges 35 and 105, but rotation is permitted because the element is sized to fit rotatably in the fixed axial distance between flanges 105 and 35. As shown in FIG. 3, there are a plurality of spaced openings 160 around the perimeter of the rotatable annular element 150, which act to direct the flow of water in a desired direction. Cooling is provided to the light through the openings 160 even when water is not being circulated by the pump.

Water from the pump flows through the water line fitting 25, around the light assembly 10, and through the openings 160 in the rotatable annular element 150. The light assembly body 125 also includes two integral external annular ridges 170, together defining an annular space to accommodate an O-ring seal 175, which, when the light assembly 10 is installed in the return fitting 5, engages the wall 180 of the return fitting 5 and prevents water from entering the electrical junction box 60 or leaking from the fitting 5.

To install the underwater return light fitting, the return water inlet fitting 5 is secured to the pool wall, the rotatable annular element 150 is placed around the return water inlet fitting 5, and the light assembly 10 is placed through the center of the rotatable annular element 150 and into the return water inlet fitting 5 with the lens 40 facing into the pool with the tabs 113 abutting the securing ring 90. The lock nut 55 is then secured in place, securing the light assembly but allowing the annular element 150 to rotate. Finally electrical connections 75 are made and the electrical junction box 60 is snapped into place. Instead of having a halogen bulb housed in the structure of the invention, the light source may include a bundle of optical fibers for coupling light from a remote location into the structure. This arrangement simplifies the structure to some degree and alleviates the cooling requirements, but requires that a separate housing be provided for a remote light source.

Figure 4:
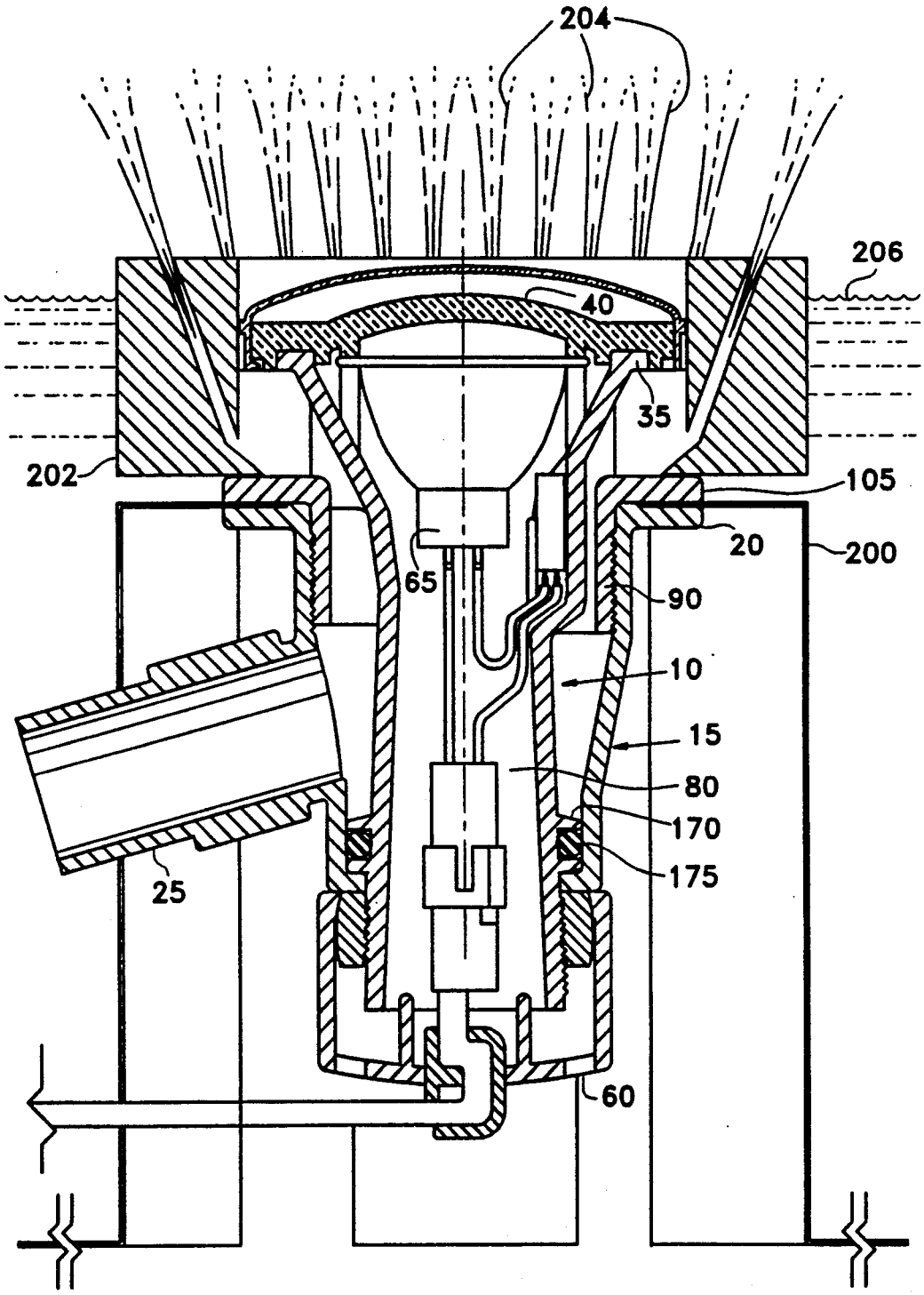
FIG. 4 is an elevational view, partly in section, of an alternate embodiment of the invention as used in an ornamental fountain; and FIG. is an elevational view of yet another embodiment of the invention, having multiple lens elements.

As shown in FIG. 4, the device of the invention may be conveniently formed as a combined water and light source in a fountain. Many of the features shown in FIG. 4 are common to those shown in FIG. 1 and like reference numerals have been used wherever appropriate. The principal differences are that the device of FIG. 4 is usually oriented vertically, is mounted on cylindrical pedestal 200, and includes a water outlet fitting 202 that is designed to fit over the light assembly 10 and provide multiple jets of liquid, indicated at 204, emerging from the device at selected angles. Typically, the device of FIG. 4 will be installed almost completely submerged under water, the surface of which is indicated at 206.

For some applications of the invention, the water outlet fitting 202 (FIG. 4), or the annular element 150 (FIG. 1), may be self rotating, i.e. the jets may be angled to provide a tangential component that rotates the fitting. In a spa application, this provides additional therapeutic action, and in the fountain application the rotating jets provide a different desired visual effect.

Figure 5:
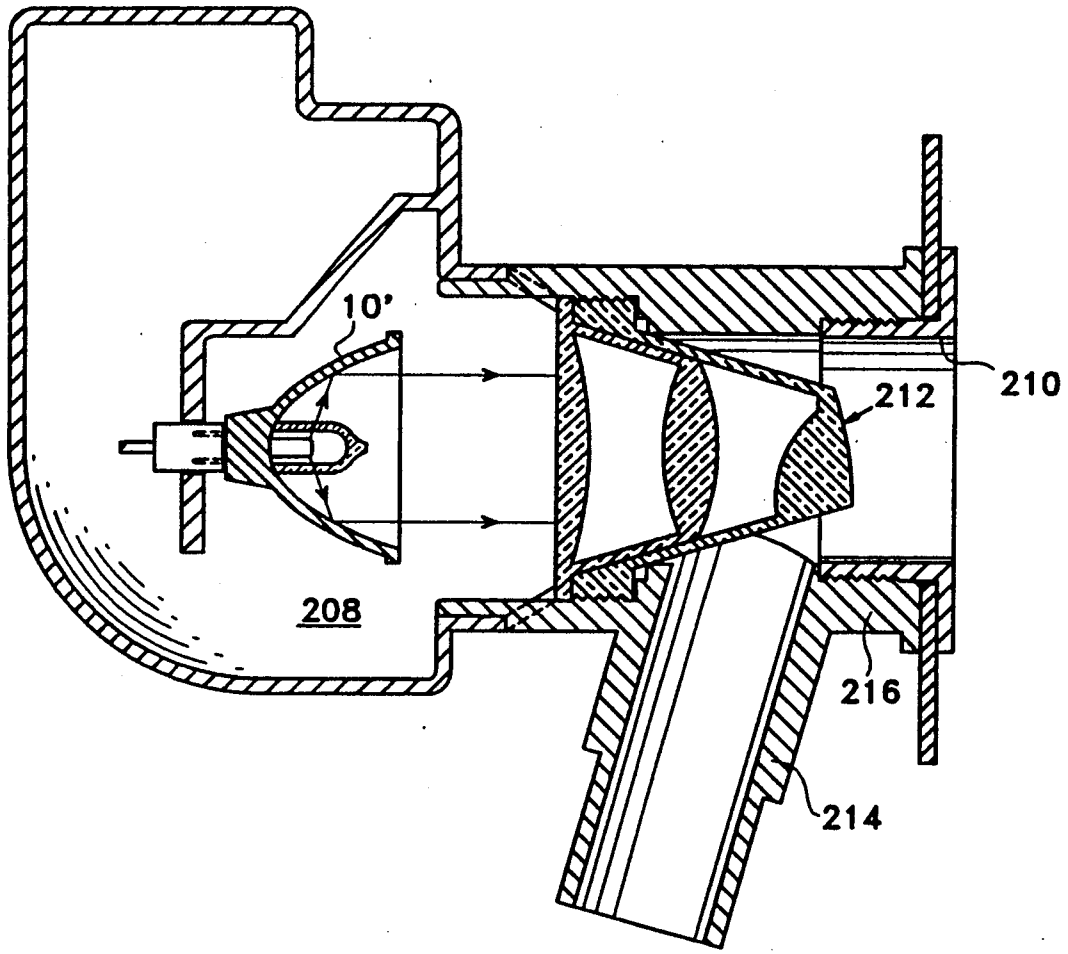

FIG. 5 shows yet another embodiment of the invention, in which the light assembly, indicated at 10', is not surrounded by circulating water. Instead, the light assembly 10' is positioned in a lamp cavity 208, which is well to the rear of an opening 210 through liquid will flow. A lens assembly 212 seals the lamp cavity 208, and a water line 214 supplies water to a body 216, part of which surrounds the lens assembly 12. The lens assembly includes multiple lens surfaces that are integrated into the assembly and provide a desired light pattern, which emerges through the opening 10 with the circulated water.

It will be appreciated from the foregoing that the present invention represents a significant advance in the field of light fittings for pools and other large open liquid containers. In particular, the invention combines an underwater pool light with a return water inlet fitting as a unitary structure. Therefore, no additional opening is required to install the light in the pool wall leakage is less likely. Moreover, the circulating water in the return water inlet fitting can be used to cool the light and thereby increase the life of the bulb. It will also be appreciated that, although a specific embodiment of the invention has been described in detail for purposes of illustration, various modifications may be made without departing from the spirit and scope of the invention. It will be understood, for example, that the principles described in relation to an illustrative underwater pool light and return fitting could also be applied to other large liquid containers having need for both a light assembly and a liquid circulation fitting. The circulation fitting may be returning liquid to the container, or drawing liquid from the container, such as through a pool skimmer. Moreover, the combined light and circulation fitting may be located below or above the surface of the liquid in the container. Accordingly, the invention is not to be limited except as by the appended claims.

I claim:

1. For use in conjunction with a water circulation system in a pool, tub or spa, a combination comprising:

a light assembly for installation beneath water level in a pool, tub or spa; and a return water inlet fitting for connection to a water circulation system, to return circulating water to the pool, wherein the light assembly and the return water inlet fitting form a unitary structure for attachment to a single opening in a wall of the pool, tube or spa;

a water line fitting for coupling the circulation system to an opening in the return water inlet fitting; and a directionally adjustable port surrounding the light assembly on the inside of the pool, tube or spa;

whereby the circulating water emerges from the port in any desired direction.

2. A combination as defined in claim 1, wherein:

the water line fitting can accommodate any of a plurality of water line sizes.

3. A combination as defined in claim 1, wherein:

the directionally adjustable port includes a rotatable annular element surrounding the light assembly and having a plurality of openings through which water emerges in a desired direction.

4. A combination as defined in claim 1, wherein:

the directionally adjustable port has at least some openings that are oriented to produce jets with a tangential component, to rotate the port.

5. For use in conjunction with a water circulation system in a pool, tub or spa, a combination comprising:

a light assembly for installation beneath water level in a pool, tub or spa;

a return water inlet fitting for connection to a water circulation system, to return circulating water to the pool, wherein the light assembly and the return water inlet fitting form a unitary structure for attachment to a single opening in a wall of the pool, tub or spa; and means for cooling the light assembly, including means for circulating air within the light assembly and venting air to the exterior of the pool tub or spa;

wherein the means for circulating air within the light assembly includes an air chamber surrounding the light source; and an electrical junction box coupled to the air chamber but sealed from the means for circulating water around the light assembly and having a plurality of exit vents;

whereby the heated air escapes through the exit vents.

6. For use in conjunction with a liquid circulation system in a liquid container, a combination comprising:

a light assembly for installation in a liquid container;

a liquid circulation fitting through which fluid flows to or from the container, wherein the light assembly and the circulation fitting form a unitary structure for installation in the liquid container;

a pipe fitting for coupling to an opening in the liquid circulation fitting; and a directionally adjustable port surrounding the light assembly on the inside of the liquid container;

whereby the circulating liquid emerges from the port in any desired direction.

7. A combination as defined in claim 6, wherein:

the pipe fitting can accommodate any of a plurality of liquid pipe sizes.

8. A combination as defined in claim 6, wherein:

the directionally adjustable port includes a rotatable annular element surrounding the light assembly and having a plurality of openings through which liquid emerges in a desired direction.

9. A combination as defined in claim 6, wherein:

the directionally adjustable port has at least some openings that are oriented to produce jets with a tangential component, to rotate the port.

10. For use in conjunction with a liquid circulation system in a liquid container, a combination comprising:

a light assembly for installation in a liquid container;

a liquid circulation fitting through which fluid flows to or from the container, wherein the light assembly and circulation fitting form a unitary structure for installation in the liquid container; and means for cooling the light assembly, including means for circulating air within the light assembly and venting air to the exterior of the liquid container;

wherein the means for circulating air within the light assembly includes an air chamber surrounding the light source; and an electrical junction box coupled to the air chamber but sealed from the means for circulating water around the light assembly and having a plurality of exit vents;

whereby the heated air escapes through the exit vents.

11. A combined pool light and water inlet assembly for installation in an opening through the wall of a pool, tub or spa, the wall having a forward surface facing into the water and an oppositely-facing rear surface, the assembly comprising:

an inlet housing having a generally tubular body insertable into the opening in the wall to a position extending therethrough;

clamping and sealing means connected to the body, having front and rear portions abutting the forward and rear surfaces of the wall, respectively, for clamping the inlet housing fixedly in position in the opening in the wall and sealing against passage of water between the exterior of the body of the wall opening, at least one of the portions of the clamping means being movable to a position permitting placement of the body into and through the opening;

a generally tubular light housing insertable into the inlet housing, the light housing having a lens sealingly mounted across an open forward end of the light housing; and a light source mounted within the light housing to direct light through the lens;

front supporting means and rear supporting means connecting forward and rear ends of the light housing to forward and rear regions of the inlet housing, respectively, for supporting the light housing within the inlet housing with spaced regions between them to form a generally annular water passage between the inlet housing and the light housing;

sealing means extending between the light housing and the light housing for creating a closed rear end to the water passage;

at least one port between the inlet housing and the light housing for placing a forward end of the water passage in communication with the pool; and means for connecting a water inlet conduit to the inlet housing for supplying water to the water passage.

12. An assembly as defined in claim 11 wherein:

one of the portions of the clamping and sealing means comprises a first flange fixedly connected to the body extending radially therefrom and abutting one of the forward and rear surfaces of the wall around the opening; and the other portion of the clamping and sealing means comprises a second flange, the second flange having a surface overlapping the periphery of the opening in the wall and abutting the opposite surface of the wall around the opening; and a threaded region for engaging a correspondingly threaded region of the body of the inlet housing.

13. An assembly as defined in claim 12 wherein the threaded regions of the second flange and the tubular body are of sufficient axial extent to accommodate pool walls of various thicknesses.

14. An assembly as defined in claim 12 wherein:

the second flange has a surface abutting the forward surface of the pool wall;

the second flange further includes an axially extending, threaded stem projecting rearwardly from the surface of the second flange; and the generally tubular body is threaded to engage the stem, the stem having a central opening extending through the second flange to constitute a portion of the water passage.

15. An assembly as defined in claim 11 wherein:

the front supporting means includes:

a rearwardly facing engagement surface on the light housing adjacent its forward end; and an abutment surface connected with the inlet housing for engaging the engagement surface on the light housing to limit rearward movement thereof through the inlet housing;

and wherein the rear supporting means includes an annular shoulder at the rear of the inlet housing having a central opening to receive and support the rear end of the light housing;

a threaded region of the light housing projecting through and rearwardly of the annular shoulder; and a securing member engaging the threaded region of the light housing to bear against the annular shoulder and draw the engagement surface of the light housing firmly against the abutment surface.

16. An assembly as defined in claim 15 wherein the sealing means comprises an annular resilient seal carried by one of the inlet housing and the light housing, extending into peripherally continuous sealing contact with the other of the inlet housing and the light housing.

17. An assembly as defined in claim 11 wherein:

the light source is housed within a sealed unit comprising a front light-transmitting wall and a generally parabolic shell with electrical connections extending rearwardly therefrom;

and wherein the light housing includes a generally conical forward region to which the lens is mounted, extending rearwardly and convergently therefrom; and a generally tubular region extending rearwardly from the conical region;

and supporting means supporting the light source within the conical portion with the electric connections extending rearwardly through the tubular region.

18. An assembly as defined in claim 11 wherein:

the front supporting means includes a water inlet annulus extending around and engaging a forward region of the light housing, the annulus being spaced forwardly of the inlet housing extending into contact therewith; and the annulus has at least one port for directing water from the water passage into the pool.

19. An assembly as defined in claim 18 wherein the water inlet annulus is mounted for rotation to enable the direction of water entering the pool through the port to be varied.

20. An assembly as defined in claim 18 wherein the water inlet annulus includes a plurality of ports, each of which is configured to direct water into the pool in a direction exerting a reaction force acting tangentially of the annulus, the water streams issuing from the ports creating a torque for rotating the annuls in one direction, whereby the annulus is rotated as water enters the pool through the ports.

21. The assembly as defined in claim 11 further including:

an opening in the light housing for placing the interior of the light housing in communication with atmosphere, whereby air can circulate within the light housing.

22. For use in a combined pool light and water inlet assembly of the type having an inlet housing extending through an opening in a pool wall, internal sealing regions within the inlet housing for limiting internal water flow and a threaded securing member positioned adjacent and externally of a rear end of the inlet housing, a replaceable lighting unit comprising:

a sealed light source including a light-transmitting front wall and a generally parabolic shell, with electrical connections extending rearwardly therefrom;

a light housing enclosing the electric light, the light housing including a generally conical region extending around and partially enclosing the light source;

a lens sealing secured to and extending across an open end of the conical region of the light housing, the lens and the conical region being sufficiently spaced from the light source to permit circulation of air therearound; and a generally tubular portion extending rearwardly from the conical portion;

supporting means mounted within the light housing for supporting the light source in position within the conical region with the electrical connections extending through the tubular portion rearward from the supporting means;

a threaded region on the tubular portion of the light housing adjacent its rear end, for engagement with the securing member of the inlet housing; and a sealing ring mounted on the light housing and projecting outwardly therefrom for engagement with internal sealing regions of the inlet housing.

23. A method of mounting a combined pool light and water inlet assembly in an opening through a wall of a pool, the wall having a forward side facing into the interior of the pool and an oppositely facing rear side, the assembly including an inlet housing having a generally tubular body insertable into the opening in the wall to extend therethrough, and front and rear clamping portions connected to the body on opposite sides of the wall for clamping the inlet housing fixedly in position in the opening, at least one of the portions initially being separate from the body to permit placement of the body into and through the opening and then being attached to the body to participate in clamping the body to the wall, a light housing insertable into and through the inlet housing up to a predetermined position at which its further rearward movement is arrested, and a connecting mechanism connecting the light housing to the inlet housing adjacent its rear end, the method comprising the steps of:

installing the inlet housing, with the one clamping portion separated from it, into the opening until the other clamping portion comes into abutment with the wall;

attaching the one clamping portion to the body against the other side of the wall to clamp the inlet housing in place;

inserting the light housing from the front side of the wall rearwardly through the inlet housing until its further rearward movement is arrested; and connecting the light housing adjacent its rear end to the inlet housing adjacent its rear end, to fixedly secure the light and inlet housings together.

24. The method as defined in claim 23 wherein the assembly includes an engagement surface on the light housing adjacent its forward end and a water directing annulus encircling the light housing, the method including the further steps of:

before inserting the light housing into the inlet housing, placing the water directing annulus around the light housing; and before inserting the light housing into the inlet housing, placing the water directing annulus around the light housing; and then inserting the light housing into the inlet housing and moving it rearwardly therethrough until further movement is arrested by contact between the engagement surface on the light housing, the water directing annulus and the forward end of the inlet housing.

25. The method as defined in claim 23 wherein the light housing is threaded adjacent its rear end and passes through an annular shoulder at the rear end of the inlet housing, and wherein the step of connecting the housings comprises:

threading a securing member onto the threaded region of the light housing until the member comes into abutment with the annular shoulder and tightening and securing member against the annular shoulder to assemble the housings firmly together.

26. For use in conjunction with a water circulation system in a pool, tub or spa, a combination comprising:

a light assembly for installation in a pool, tub or spa; and a return water inlet fitting for connection to a water circulation system, to return circulating water to the pool, wherein the light assembly and the return water inlet fitting form a unitary structure for attachment to a single opening in a wall of the pool, tube or spa;

a water line fitting for coupling the circulation system to an opening in the return water inlet fitting; and a directionally adjustable port integrated with the light assembly on the inside of the pool, tub or spa;

whereby the circulating water emerges from the port in any desired direction.

27. For use in conjunction with a liquid circulation system in a liquid container, a combination comprising:

a light assembly for installation in a liquid container;

a liquid circulation fitting through which fluid flows to or from the container, wherein the light assembly and the circulation fitting form a unitary structure for installation in the liquid container;

a pipe fitting for coupling to an opening in the liquid circulation fitting; and a directionally adjustable port integrated with the light assembly on the inside of the liquid container;

whereby the circulating liquid emerges from the port in any desired direction.

28. A combined pool light and water inlet assembly for installation in an opening through the wall of a pool, tub or spa, the wall having a forward surface facing into the water and an oppositely-facing rear surface, the assembly comprising:

an inlet housing having a generally tubular body insertable into the opening in the wall to a position extending therethrough;

means for removably attaching the tubular body in sealing contact with the opening;

a generally tubular light housing insertable into the inlet housing, the light housing having a lens sealingly mounted across an open forward end of the light housing; and a light source mounted to direct light through tubular light housing and the lens;

means for supporting the tubular light housing within the inlet housing with spaced regions between them to form a generally annular water passage between the inlet housing and the light housing;

sealing means extending between the inlet housing and the light housing, for creating a closed rear end to the water passage;

at least one port between the inlet housing and the light housing for placing a forward end of the water passage in communication with the pool; and means for connecting a water inlet conduit to the inlet housing for supplying water to the water passage.

* * * * *